US007140711B2

(12) United States Patent
Nerad et al.

(10) Patent No.: US 7,140,711 B2
(45) Date of Patent: Nov. 28, 2006

(54) METHOD AND APPARATUS FOR INKJET PRINTING USING RADIATION CURABLE INK

(75) Inventors: Bruce A. Nerad, Oakdale, MN (US); Robin E. Wright, Inver Grove Heights, MN (US); Richard L. Severance, Stillwater, MN (US); William J. Hunt, Afton, MN (US); Caroline M. Ylitalo, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 320 days.

(21) Appl. No.: 10/624,012

(22) Filed: Jul. 21, 2003

(65) Prior Publication Data

US 2005/0018026 A1 Jan. 27, 2005

(51) Int. Cl.
*B41J 29/393* (2006.01)
*B41J 2/01* (2006.01)

(52) U.S. Cl. ..... 347/19; 347/102

(58) Field of Classification Search ..... 347/19, 347/102; 34/275, 277, 524; 101/488; 400/120.18
See application file for complete search history.

(56) References Cited

U.S. PATENT DOCUMENTS

| | | | | |
|---|---|---|---|---|
| 4,033,263 A | * | 7/1977 | Richmond | 101/424.1 |
| 4,469,026 A | | 9/1984 | Irwin | |
| 4,774,523 A | | 9/1988 | Beaufort et al. | |
| 5,275,646 A | | 1/1994 | Marshall et al. | |
| 5,349,905 A | | 9/1994 | Taylor et al. | |
| 5,440,137 A | | 8/1995 | Sowers | |
| 5,502,464 A | | 3/1996 | Takahashi et al. | |
| 5,508,826 A | | 4/1996 | Lloyd et al. | |
| 5,511,477 A | | 4/1996 | Adler et al. | |
| 5,530,466 A | | 6/1996 | Fujioka et al. | |
| 5,614,933 A | | 3/1997 | Hindman et al. | |
| 5,721,086 A | | 2/1998 | Emslander et al. | |
| 5,722,761 A | * | 3/1998 | Knight | 362/96 |
| 5,757,407 A | | 5/1998 | Rezanka | |
| 5,771,054 A | | 6/1998 | Dudek et al. | |

(Continued)

FOREIGN PATENT DOCUMENTS

| | | |
|---|---|---|
| EP | 0 134 591 | 3/1985 |
| EP | 0 658 607 | 6/1995 |
| EP | 0 889 639 | 1/1999 |
| EP | 0 978 390 | 2/2000 |
| EP | 1 034 936 | 9/2000 |

(Continued)

OTHER PUBLICATIONS

Pending U.S. Appl. No. 10/211,027, filed Aug. 2, 2002.
Practical Considerations for Using UV Reactive Inks in Piezo DOD Printheads, Richar J. Baker, Spectra Inc., Hanover, New Hampshire, USA, 1999, pp. 111–115.

(Continued)

*Primary Examiner*—Thinh Nguyen
(74) *Attorney, Agent, or Firm*—James D. Christoff

(57) ABSTRACT

Inkjet printing apparatus for use with radiation curable ink includes a sensor for sensing the amount of radiation emitted by a source of radiation. A controller is connected to the sensor and is operable to vary the amount of radiation emitted by the radiation source in accordance with a signal received from the sensor. A drive mechanism moves the source of radiation to a location laterally offset from the substrate where the sensor is positioned.

37 Claims, 2 Drawing Sheets

U.S. PATENT DOCUMENTS

| | | | | | |
|---|---|---|---|---|---|
| 5,847,743 | A | | 12/1998 | Look | |
| 5,875,287 | A | | 2/1999 | Li et al. | |
| 5,975,677 | A | | 11/1999 | Marler et al. | |
| 5,981,113 | A | | 11/1999 | Christian | |
| 6,039,426 | A | | 3/2000 | Dobbs | |
| 6,082,911 | A | | 7/2000 | Murakami | |
| 6,092,890 | A | | 7/2000 | Wen et al. | |
| 6,114,022 | A | | 9/2000 | Warner | |
| 6,145,979 | A | | 11/2000 | Caiger et al. | |
| 6,154,227 | A | * | 11/2000 | Lund | 347/14 |
| 6,248,404 | B1 | | 6/2001 | Greene-Mathis | |
| 6,350,071 | B1 | | 2/2002 | Conwell et al. | |
| 6,447,112 | B1 | | 9/2002 | Hu et al. | |
| 6,517,184 | B1 | | 2/2003 | Bruch et al. | |
| 6,543,890 | B1 | | 4/2003 | Ylitalo et al. | |
| 6,550,906 | B1 | | 4/2003 | Ylitalo | |
| 6,554,414 | B1 | | 4/2003 | Ylitalo et al. | |
| 6,595,615 | B1 | | 7/2003 | Ylitalo | |
| 2002/0085056 | A1 | | 7/2002 | Ylitalo | |
| 2002/0140794 | A1 | | 10/2002 | Asano et al. | |
| 2002/0174561 | A1 | * | 11/2002 | Conwell et al. | |
| 2003/0011670 | A1 | * | 1/2003 | Shirakawa | |
| 2003/0222961 | A1 | * | 12/2003 | Nakajima | 347/102 |

FOREIGN PATENT DOCUMENTS

| | | | | |
|---|---|---|---|---|
| EP | 1 046 511 | | | 10/2000 |
| EP | 1 108 553 | | | 6/2001 |
| EP | 0 875 382 | | | 12/2002 |
| EP | 1 426 191 | | | 6/2004 |
| GB | 2 142 579 | | | 1/1985 |
| GB | 2 233 928 | | | 1/1991 |
| GB | 2 322 597 | | | 9/1998 |
| GB | 2 338 212 | | | 12/1999 |
| JP | 2-92642 | | | 10/1985 |
| JP | 62-109645 | | | 2/1987 |
| JP | 1-133746 | | | 5/1989 |
| JP | 02020015 | A | * | 1/1990 |
| JP | 04341374 | A | * | 11/1992 |
| JP | 6-200204 | | | 7/1994 |
| JP | 8-218016 | | | 8/1996 |
| JP | 8-218017 | | | 8/1996 |
| JP | 8-218018 | | | 8/1996 |
| JP | 10-207978 | | | 7/1998 |
| JP | 11-70645 | | | 3/1999 |
| JP | 2000211219 | | | 8/2000 |
| JP | 2002-144555 | | | 5/2002 |
| WO | WO 97/04964 | | | 2/1997 |
| WO | WO 97/27053 | | | 7/1997 |
| WO | WO 97/31071 | | | 8/1997 |
| WO | WO 99/08875 | | | 2/1999 |
| WO | WO 99/29788 | | | 6/1999 |
| WO | WO 01/17780 | | | 3/2001 |
| WO | WO 01083223 | A | * | 11/2001 |
| WO | WO 02/04214 | | | 1/2002 |
| WO | WO 02/18144 | | | 3/2002 |
| WO | WO 02/053382 | | | 7/2002 |
| WO | WO 02/078958 | | | 10/2002 |

OTHER PUBLICATIONS

Noguchi, Hiromichi, Final Program and Proceedings of IS&T's NIP14: International Conference on Digital Printing Technologies, IS&T—The Society for Imaging Science and Technology, Oct. 1998, UV Curable, Aqueous Ink Jet Ink: Material Design and Performance for Digital Printing, pp. 107–110.

* cited by examiner

METHOD AND APPARATUS FOR INKJET PRINTING USING RADIATION CURABLE INK

BACKGROUND OF THE INVENTION

1. Field of the Invention

This invention relates to inkjet printing apparatus and methods for inkjet printing using ink that is curable upon exposure to actinic radiation such as UV radiation. More particularly, the present invention is directed to automated methods and apparatus for controlling the parameters used in inkjet printing.

2. Description of the Related Art

Inkjet printing has increased in popularity in recent years due to its relatively high speed and excellent image resolution. Moreover, inkjet printing apparatus used in conjunction with a computer provides great flexibility in design and layout of the final image. The increased popularity of inkjet printing and the efficiencies in use have made inkjet printing an affordable alternative to previously known methods of printing.

In general, there are three types of inkjet printers in widespread use: the flat bed printer, the roll-to-roll printer and the drum printer. In a typical flat bed printer, the medium or substrate to receive the printed image rests on a horizontally extending flat table or bed. An inkjet print head is mounted on a movable carriage or other type of mechanism that enables the print head to be moved along two mutually perpendicular paths across the bed. The print head is connected to a computer that is programmed to energize certain nozzles of the print head as the print head traverses across the substrate, optionally using inks of different colors. The ink on the substrate is then cured as needed to provide the desired final image.

In roll-to-roll inkjet printers, the substrate to receive the printed image is commonly provided in the form of an elongated web or sheet and advances from a supply roll to a take-up roll. At a location between the supply roll and the take-up roll, a print head is mounted on a carriage that is movable to shift the print head across the substrate in a direction perpendicular to the direction of advancement of the substrate. Known roll-to-roll inkjet printers include vertical printers, wherein the substrate moves in an upward direction past the print head, as well as horizontal printers, wherein the substrate moves in a horizontal direction past the print head.

Drum inkjet printers typically include a cylindrical drum that is mounted for rotational movement about a horizontal axis. The substrate is placed over the periphery of the drum and an inkjet print head is operable to direct drops of ink toward the substrate on the drum. In some instances, the print head is stationary and extends along substantially the entire length of the drum in a horizontal direction. In other instances, the length of the print head is somewhat shorter than the length of the drum and is mounted on a carriage for movement in a horizontal direction across the substrate and parallel to the rotational axis of the drum.

Inks that are commonly used in inkjet printers include water-based inks, solvent-based inks and radiation-curable inks. Water-based inks are used with porous substrates or substrates that have a special receptor coating to absorb the water. In general, water-based inks are not satisfactory when used for printing on non-coated, non-porous films.

Solvent-based inks used in inkjet printers are suitable for printing on non-porous films and overcome the problem noted above relating to water-based inks. Unfortunately, many solvent-based inks contain about 90 percent organic solvents by weight. As solvent-based inks dry, the solvent evaporates and may present an environmental hazard. Although environmental systems may be available for reducing the emission of solvents to the atmosphere, such systems are generally considered expensive, especially for the owner of a small print shop.

Furthermore, inkjet printers using either solvent-based inks or water-based inks must dry relatively large quantities of solvent or water before the process is considered complete and the resulting printed product can be conveniently handled. The step of drying the solvents or water by evaporation is relatively time-consuming and can be a rate limiting step for the entire printing process.

In view of the problems noted above, radiation-curable inks have become widely considered in recent years as the ink of choice for printing on a wide variety of non-coated, non-porous substrates. The use of radiation curing enables the ink to quickly cure (commonly considered as "instant" drying) without the need to drive off large quantities of water or solvent. As a result, radiation curable inks can be used in high speed ink-jet printers that can achieve production speeds of over 1000 $ft^2$/hr (93 $m^2$/hr.) The most common radiation curable inkjet inks are formulated to cure when exposed to actinic radiation, which is radiation having a wavelength in the ultraviolet ("UV") or visible region of the spectrum.

Inkjet printers that are capable of printing on relatively large substrates are considered expensive. Accordingly, it is desired to use the same printer to impart images to a wide variety of substrates using a wide variety of ink compositions if at all possible. Moreover, it is preferred that each image printed by such printers be of high quality on a consistent basis regardless of the type of substrate and the type of ink used, in view of the time and expense of reprinting the image in instances where the quality of the image is less than desired.

The quality of the image printed by inkjet printers using radiation curable inks is dependent upon the intensity and dosage of the radiation. In general, a lower dosage of radiation provides better adhesion of the ink to subsequent coatings that are applied to the substrate. However, a higher dosage of radiation generally provides an image with better mar and solvent resistance in instances where the ink is not covered by a subsequent coating.

The printer operator often has little assurance that the selected intensity and dosage of radiation will provide the best image quality for any particular combination of ink, substrate and radiation source. Many operators today use a UV meter periodically to check the intensity of emitted radiation. However, such a procedure is cumbersome and time-consuming. Moreover, if the source of radiation is unexpectedly diminished by, for example, a defect or aging of the bulb, the printing process may continue for some time until the operator notices that the quality of the images has been adversely affected.

In view of the foregoing, there is a need in the art for new methods and apparatus of inkjet printing that would consistently enable high quality images to be printed without undue reliance upon the operator's degree of attentiveness. Preferably, such methods and apparatus would be automated and not require a significant amount of operator skill.

SUMMARY OF THE INVENTION

The present invention is directed toward automated methods and apparatus for controlling the amount of radiation received by radiation curable ink used in ink-jet printing. A sensor such as a UV radiation sensor is connected to the controller of the printer and provides a signal in accordance with the amount of detected radiation. The controller, in turn, automatically modifies parameters used in the printing and/or curing process so that each image is of high quality even though the amount of the radiation may vary from time to time.

In more detail, the present invention in one aspect is directed to an inkjet printing apparatus for radiation curable ink. The apparatus comprises a support for receiving a substrate and a print head for directing radiation curable ink toward a substrate received on the support. The apparatus also includes a source of radiation for providing radiation to ink received on the substrate, and a sensor for sensing the amount of radiation emitted by the source of radiation. The apparatus further includes a controller having an input for receiving a signal from the sensor and at least one characteristic of the ink, substrate or printing productivity parameters. The controller is connected to the source of radiation and varies the amount of radiation delivered by the source of radiation in accordance with the signal received from the sensor and the at least one characteristic of the ink, substrate or printing productivity parameters.

Another aspect of the invention is directed toward a method of inkjet printing. The method comprises:

selecting a radiation curable ink;

selecting a substrate;

entering at least one characteristic of the ink, substrate or printing productivity parameters into a controller;

directing the ink onto the substrate;

activating a source of radiation for providing radiation to ink received on the substrate;

sensing the amount of radiation emitted by the source of radiation; and varying the amount of radiation delivered by the source of radiation in accordance with the sensed amount of radiation and the at least one characteristic of the ink, substrate or printing productivity parameters.

The present invention is also directed in another aspect to inkjet printing apparatus for radiation curable ink. In this aspect, the apparatus comprises a support for receiving a substrate and a print head for directing radiation curable ink toward the substrate received on the support. The apparatus further includes a source of radiation and a sensor for sensing the amount of radiation emitted by the source of radiation. The apparatus additionally includes means for directing the radiation along a first path toward the substrate in order to provide radiation to ink received on the substrate and also for directing radiation along a second path toward the sensor. The first path is different from the second path.

The present invention is also directed in another aspect to a method of ink-jet printing. The method comprises:

providing a substrate;

applying radiation curable ink to the substrate;

directing radiation along a first path and toward ink received on the substrate;

directing radiation along a second path and toward a radiation sensor; and varying the amount of radiation directed toward the ink in accordance with the amount of radiation detected by the sensor.

Another aspect of the present invention is also directed toward inkjet printing apparatus for radiation curable ink. In this aspect, the apparatus comprises a support for receiving a substrate and a print head for directing radiation curable ink toward a substrate received on the support. The apparatus further includes a source of radiation and a drive mechanism for moving the source of radiation along a path across the substrate in order to direct radiation toward ink received on the substrate. The path also extends to a certain location laterally offset from the substrate. The apparatus additionally includes a sensor next to the certain location for sensing the amount of radiation emitted by the source of radiation when the source of radiation is in the certain location.

An additional aspect of the present invention is also directed toward a method of inkjet printing. This method comprises:

providing a substrate;

applying radiation curable ink to the substrate;

moving a source of radiation across the substrate in order to provide radiation to ink received on the substrate;

moving the source of radiation to a certain location that is laterally offset from the substrate; and sensing the amount of radiation emitted by the source of radiation when the source of radiation is in the certain location.

These and other aspects of the invention are described in more detail below and are illustrated in the accompanying drawings.

DETAILED DESCRIPTION OF THE PREFERRED EMBODIMENTS

Figure 1:
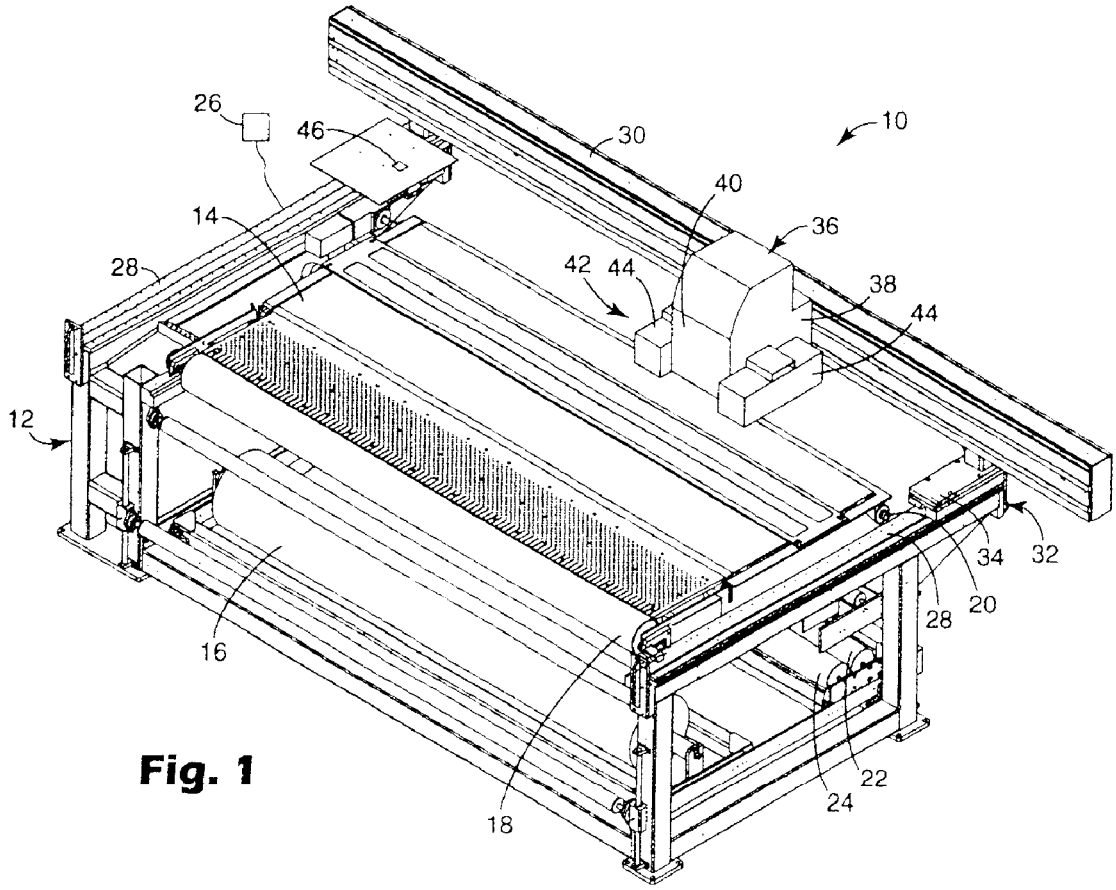
FIG. 1 is a top, front and right side perspective view of a portion of an ink-jet printing apparatus constructed according to the present invention.

An inkjet printing apparatus according to one embodiment of the present invention is illustrated in FIGS. 1–4 and is broadly designated by the numeral 10. The apparatus includes a frame 12 that provides support for various components of the apparatus 10 as well as a housing (not shown) that surrounds the frame 12. A support 14 is connected to the frame 12 and extends in a generally horizontal plane for supporting a substrate to receive a printed image.

The apparatus 10 includes an unwind roll 16 for receiving a roll of substrate during use of the apparatus 10 in roll-to-roll printing. The unwind roll 16 is rotatably coupled to a lower portion of the frame 12. From the unwind roll 16, the substrate passes over a roller 18 and onto the support 14. From the support 14, the substrate advances over a roller 20 and onto a windup roll 22.

A drive roller 24 is also connected to a lower portion of the frame 12 adjacent the windup roll 22 and frictionally engages the substrate as it advances onto the windup roll 22. The drive roller 24 is connected to a motor (not shown) that, in turn, is electrically connected to a controller 26. When the controller 26 activates the motor to rotate the drive roller 24, the drive roller 24 advances the substrate along a path from the unwind roll 16, over the roller 18, across the support 14, over the roller 20 and onto the windup roll 22.

A pair of horizontal, parallel rails 28 are connected to the frame 12 and extend in directions parallel to the plane of the support 14 as well as to the path of travel of the substrate as it moves across the support 14. A bridge 30 extends over both of the rails 28 in a direction perpendicular to the longitudinal axis of the rails 28. A bridge drive mechanism 32 is operable to move the bridge 30 in either direction along the length of the rails 28.

The bridge drive mechanism 32 may be any one of a number of suitable devices for moving the bridge 30 along the rails 28. In the illustrated embodiment, the bridge drive mechanism 32 comprises two drive units 34, each of which includes a linear drive motor that is electrically connected to the controller 26. The motor of each drive unit 34 interacts with an elongated permanent magnet mounted on the associated rail 28 to move the bridge 30 upon activation of the motor. One of the rails 28 and drive units 34 includes an encoder (not shown) that is electrically connected to the controller 26, so that the position of the bridge 30 along the rails 28 can be determined at any time.

A carriage 36 is mounted on the bridge 30 for movement in either direction along the longitudinal axis of the latter. As such, the carriage 36 is movable in a direction perpendicular to movement of the bridge 30 along the rails 28. A carriage drive mechanism 38 is electrically connected to the controller 26 for movement of the carriage 36 along the bridge 30 when desired.

The carriage drive mechanism 38, like the bridge drive mechanism 32, may be any one of a number of suitable types of drive mechanisms. For example, the carriage drive mechanism 38 may comprise a linear drive motor and elongated permanent magnet as described above. Preferably, an encoder (not shown) is associated with the carriage 36 and the bridge 30 and is electrically connected to the controller 26 for determining the location of the carriage 36 on the bridge 30 at any point in time.

A print head 40 is mounted on the carriage 36 for directing UV radiation curable ink toward a substrate. Preferably, the print head 40 comprises a bank of print head units, each of which is coupled by tubing to a source of UV radiation curable ink (not shown). In addition, the print head 40 is electrically coupled to the controller 26 for selective activation when desired. Examples of UV curable inkjet inks that can be used in the apparatus 10 include compositions such as those described in U.S. Pat. Nos. 5,275,646 and 5,981,113 and PCT application Nos. WO97/31071 and WO99/29788.

Preferably, the print head 40 is operable to simultaneously print ink of different colors. To this end, the print head 40 may include a first set of nozzles that are in fluid communication with a first source of ink of a certain color and a second set of nozzles that are in fluid communication with a second source of ink of a different color. Preferably, the print head has at least four sets of nozzles that are in communication with at least four corresponding ink sources. As a result, the print head 40 is operable to simultaneously print at least four inks of different colors so that a wide color spectrum in the final printed image can be achieved.

Optionally, the print head 40 includes one or more additional sets of nozzles that are in communication with a source of clear ink or other material that lacks color. The clear ink can be printed on the substrate before any colored ink is applied, or can be applied to the printed image. Printing clear ink over the entire image can be used to improve performance of the finished product, such as by improving durability, gloss control, resistance to graffiti and the like.

A source of radiation 42 is also connected to the carriage 36 for directing actinic radiation toward ink that is received on the substrate. The source of radiation may include one or more radiation emitting devices, each of which is operable to emit light in the ultraviolet and/or visible spectrum. In the illustrated embodiment, the source of radiation 42 includes two radiation devices 44 that are mounted on opposite sides of the print head 40.

The radiation devices 44 may be any one or more of a number of devices suitable to emit actinic radiation. Suitable sources of UV radiation include mercury lamps, xenon lamps, metal halide lamps, excimer lamps, carbon arc lamps, tungsten filament lamps, lasers, LEDs and the like. The sources may provide a continuous or a pulsed emission. Examples of mercury lamps include arc and microwave driven lamps. Mercury arc lamps may be low, medium or high pressure. Both of the radiation devices 44 are connected to the controller 26 for activation and deactivation when desired.

Figure 2:
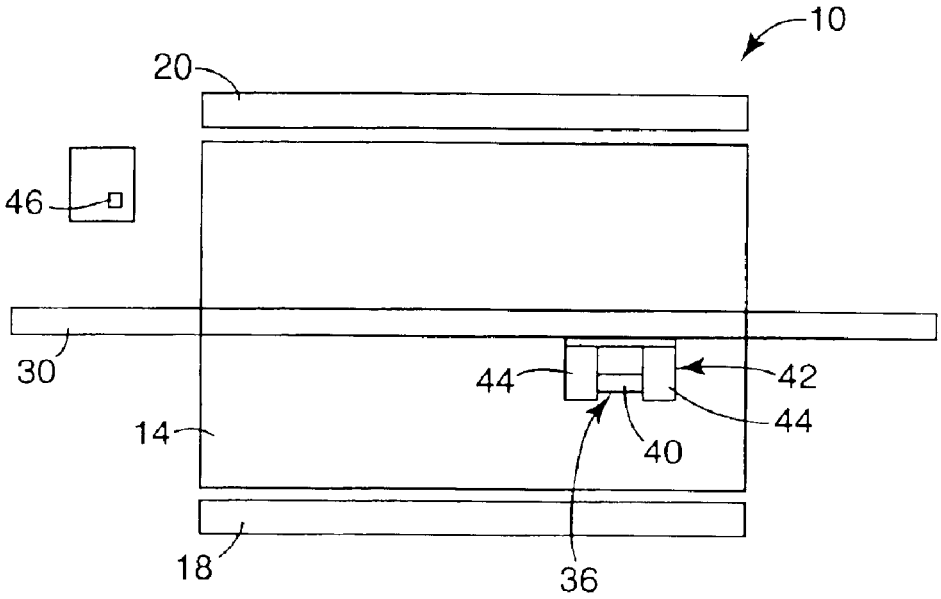
FIG. 2 is a reduced top plan view in partially schematic form showing a portion of the printing apparatus illustrated in FIG. 1.
Figure 4:
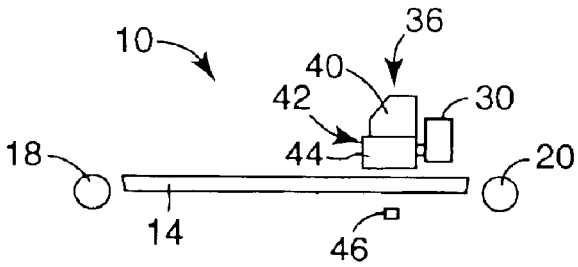
FIG. 4 is a right side elevational view in partially schematic form of a portion of the printing apparatus depicted in FIGS. 1–3.

The apparatus 10 also includes a sensor 46 for sensing the amount of radiation emitted by the source of radiation 42. As shown in FIG. 2, the sensor 46 is mounted on a stationary horizontal plate. The sensor 46 is in a location that is laterally offset from the support 14 and the substrate when received on the support 14 (i.e., the sensor 46 is located to one side of the support 14 and the substrate received on the support 14 in directions parallel to the plane of the support 14). Additionally, the sensor 46 is preferably mounted at a height that is approximately equal to the height of the support 14 or immediately beneath the same as shown in FIG. 4.

The sensor 46 is electrically connected to the controller 26. When the source of radiation 42 is located in a position directly over the sensor 46 and the source of radiation 42 is activated, the sensor 46 detects the amount of radiation received over the sensor area and sends a signal to the controller 26 in accordance with the sensed amount.

In the illustrated embodiment, the carriage 36 is operable to move each of the radiation devices 44 in sequence along a path that passes over ink received on the substrate as well as over the sensor 46. As an alternative, however, two sensors, each identical to sensor 46, may be positioned in side-by-side arrangement adjacent the support 14, so that the amount of radiation from each device 44 may be detected simultaneously.

Figure 3:
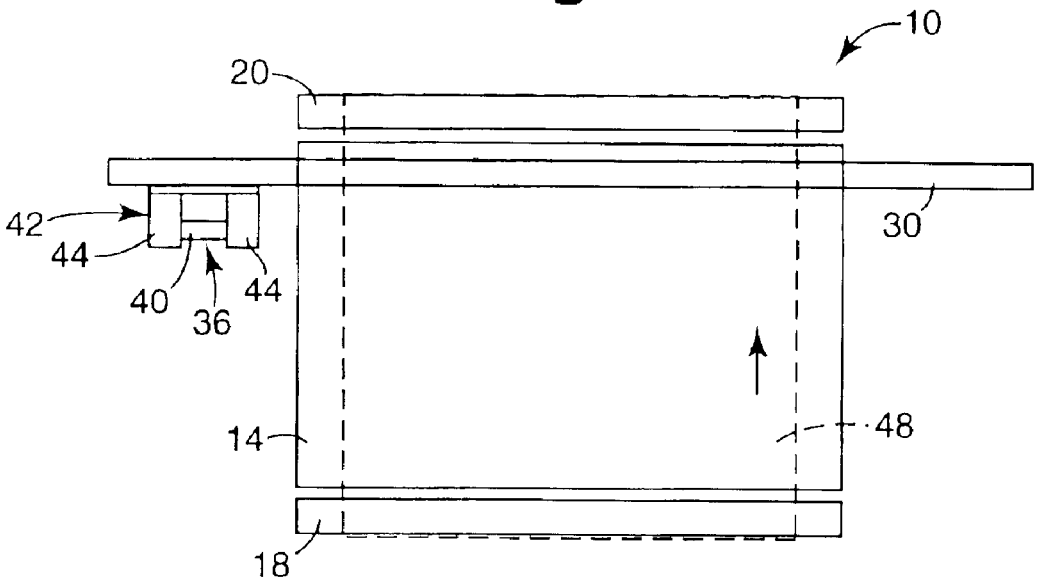
FIG. 3 is a view somewhat similar to FIG. 2 except that a radiation curing device of the printing apparatus has been moved to a position over a radiation sensor.

For purposes of illustration, a web-type substrate is shown in FIG. 3 in dashed lines and is designated by the numeral 48. During operation of the apparatus 10 in roll-to-roll printing, the controller 26 operates the drive roll 24 in order to move the substrate 48 along a path of travel over the support 14 in a direction as indicated by the arrow in FIG. 3. The substrate 48 is advanced in small incremental steps, and in the interval between advancement of the substrate 48 the carriage 36 moves along the bridge 30. As the carriage 36 moves, the controller 26 activates the print head 40 in accordance with a preprogrammed sequence of operations in order to direct ink of various colors as desired toward the substrate 48. The controller 26 also activates the source of radiation 42 as desired in order to cure ink that has been applied to the substrate 48.

In roll-to-roll printing, the bridge 30 need not be moved along the rails 28 and the bridge drive mechanism 32 need not be activated. Instead, the carriage 36 moves only along a single reference axis that is perpendicular to the arrow shown in FIG. 3. Once the carriage 36 has traversed the substrate 48, the controller 26 activates the motor connected to the drive roller 24 in order to advance the substrate 48 another incremental step, and the carriage 36 again moves across the substrate 48 to continue the printing process.

Preferably, the carriage 36 is moved to a location over the sensor 46 after each return pass of the carriage 36 across the substrate 48 so that the controller 26 can receive a signal from the sensor 46 on a frequent basis. For example, if the carriage 36 moves in a direction to the right viewing FIG. 3 across the substrate 48 for one pass of printing, and the substrate 48 is then incrementally advanced, and the carriage 36 then returns to the left for a second pass of printing and to the position shown in FIG. 3, the source of radiation 42 will be adjacent the sensor 46 after each second pass of printing. As another option, the carriage 36 may return to the position shown in FIG. 3 after each pass and during advancement of the substrate 48. As yet an additional option, an additional sensor, similar to the sensor 46, may be located on the right side of the support 48 viewing FIG. 3 so that the controller 26 can determine the amount of radiation emitted by the radiation source 42 after each pass in each direction.

Advantageously, the apparatus 10 of the illustrated embodiment is also operable in flat-bed printing mode for printing flat discrete sheets of substrate that are not wound on a roll. For example, a rectangular substrate, having dimensions somewhat smaller than the support 14, is placed on the support 14 and held stationary during the printing process. To this end, the support 14 is provided with an array of ports that are connected to a source of negative air pressure. As negative air pressure is applied to the ports, the substrate is held in a stationary position on the support 14.

During operation of the apparatus 10 in flat bed printing, both of the drive mechanisms 32, 38 are activated as needed in order to enable the carriage 36 to pass over all portions of the substrate to receive ink. For example, the controller 26 may initially activate the bridge drive mechanism 32 to move the bridge 30 to its lowest vertical position with reference to FIGS. 2 and 3, and then deactivate the mechanism 32 while activating the carriage drive mechanism 38. As the mechanism 38 is activated, the carriage 36 moves the print head 40 as well as the source of radiation 42 across the substrate in a horizontal direction viewing FIGS. 2 and 3 until the entire width of the substrate is traversed. Next, the controller 26 idles the mechanism 38 and activates the bridge drive mechanism 32 in order to move the bridge 30 an incremental step in an upwardly direction viewing FIGS. 2 and 3. The controller 26 then deactivates the bridge drive mechanism 32 and reactivates the carriage drive mechanism 38 for printing the next row. The method is then repeated until the entire image is printed on the substrate.

In use of the apparatus 10 for flat bed printing, the controller 26 activates the mechanisms 32, 38 as appropriate to move the source of radiation 42 to a location over the sensor 46 as frequently as desired. For example, the controller 26 may be programmed to move the carriage 36 to the "home" position shown in FIG. 3 before any ink is applied to the substrate. Subsequently, the controller 26 may return the carriage 36 to the home position a number of times during the printing process, or alternatively return the carriage 36 to the home position only after the entire image as been printed on the substrate.

As an additional option, the sensor 46 may be mounted on a support connected to the bridge 30, instead of the plate as shown in FIG. 1. By connecting the sensor 46 to the bridge 30, the sensor 46 moves with the bridge during operation of the apparatus 10 in flat bed printing. Preferably, when this option is elected, the controller 26 sends the carriage 36 over the sensor 46 after the carriage 36 reaches the end of each row of ink dots.

As a further option, optical fibers may be placed in the path of radiation for directing radiation to the sensor 46. For example, the optical fibers may be placed in a hole of a reflector for the lamps, and the sensor 46 may be located on the outer housing of the carriage 36.

The controller 26 has an input for receiving at least one characteristic of the group consisting of the ink, substrate 48 and operator-specified printing productivity parameters. Preferably, the input receives one or more characteristics of the substrate 48 and one or more characteristics of the ink that is supplied to the print head 40. For example, the controller 26 may include a user interface input device such as a keyboard and/or mouse for manually inputting pre-selected characteristics as desired. As another option, the controller 26 may include a barcode reading device that receives bar-coded information recorded on the substrate or a label or tag associated with the substrate, as well as a label or tag associated with a container for the ink.

Examples of ink characteristics include parameters relating to the viscosity, the composition, surface tension or the color of the ink, or related to the wavelength range of radiation wherein the ink exhibits greatest sensitivity. Examples of substrate characteristics include the composition, surface characteristics and thickness. In practice, the memory associated with the controller 26 retains a look-up table, so that the optimum amount of radiation can be determined for a given combination of ink, substrate and selected printing productivity parameters.

Examples of printing productivity parameters include the speed of travel of the carriage 36, the advancement of the substrate during roll-to-roll printing, the firing frequency of the print head nozzles and the number of nozzles used per color. Other examples of printing productivity parameters include the resolution (e.g., dots per inch) of the printed image in either or both of a cross-web direction and a down-web direction. Preferably, the controller 26 is operable to vary one or more of such printing productivity parameters in accordance with the input received from the operator and with the signal received from the sensor 46.

Preferably, the controller 26 is operable to vary the amount of radiation delivered to ink on the substrate 48 from the source of radiation 42 in accordance with the characteristics of the substrate 48 and ink and the signal received from the sensor 46. For example, the controller 26 may function to change the intensity of radiation emitted by the source of radiation 42 and/or the dosage of radiation reaching the ink or coating. Preferably, the controller 26 is also operatively connected to a user interface output device such as a visual display or monitor so that the operator can be kept informed of the radiation intensity and dosage.

The controller 26 may vary the intensity of radiation by any one or more of a number of options. For example, the voltage directed to lamps of the radiation devices 44 may be changed. As another example, the radiation devices 44 may be moved by automated drive mechanisms toward or away from the support 14 in order to change the focal lengths of lamps of the radiation devices 44.

Another option for varying the intensity of UV radiation reaching the ink and substrate can be carried out by placing or removing one or more filters or lens elements between the lamp and the substrate 48. For example, a movable cartridge, having one or more quartz or heat resistant glass filters (made, for example, of Pyrex brand glass), may be moved into or out of the path of radiation by rotation of the cartridge or by sliding the cartridge along a reference axis. Examples of other suitable filters are described in applicant's pending U.S. patent application Ser. No. 10/211,027 entitled "Methods of Making Weatherable Films and Articles". The intensity of radiation may also be altered by changing the position, size and/or shape of a reflector associated with the devices 44. Other options include selectively using diffusers that comprise metal oxide or coated mirrors.

The dosage of UV radiation reaching the ink and substrate 48 can be changed by varying the intensity as described above, or by other means as desired. For example, the relative velocity at which the radiation devices 44 pass over the ink and substrate 48 may be changed. Another option is to increase or decrease the number of powered radiation devices or to vary the interval during which lamps of radiation devices are pulsed on or off. As additional examples, a shutter or filter may be placed in the path of the emitted radiation. As another alternative, a shutter or filter may be intermittently moved into and out of the path of radiation. As yet another example, the shape and/or size of a reflector for the radiation devices 44 may be changed.

Preferably, if the amount of radiation detected by the sensor 46 is beneath a certain minimum value, the controller 26 activates an alarm or other signal to the operator to indicate that the radiation devices 44 need attention. Such a feature is especially advantageous when using radiation sources such as lamps that decrease in intensity after an extended period of use and need to be replaced for optimal efficiency of the apparatus 10.

Preferably, the controller 26 includes computer software that is associated with memory corresponding to a lookup table. The lookup table has information regarding desired intensity and dosage levels, or acceptable ranges of intensity and dosage levels, for a given combination of ink and substrate. Optionally, the computer software prompts the user to identify any subsequent coatings such as clearcoats. The target intensity and dosage levels are then selected or adjusted by the software in accordance with the formulation of the subsequent coating.

As can be appreciated, the drive mechanisms 32, 38 provide a means for directing radiation along a first path toward the substrate 48 in order to direct radiation toward ink received on the substrate. The drive mechanisms 32, 38 also comprise a means for directing radiation along a second path toward the sensor 46.

The first path of the radiation is different from the second path of the radiation. In the illustrated embodiments, the first path is parallel to but offset from the second path. However, other options are also possible. For example, the second path may extend at an angle relative to the first path by pivoting the carriage 36 about a reference axis that is perpendicular to the plane of the support 14. As another example, a mirror may be moved adjacent to the radiation devices 44 at certain intervals of time in order to direct the radiation away from the substrate 48 and toward a radiation sensor.

The apparatus 10 as described above may be constructed by modifying any one of a number of commercially available printers. For example, the "2500 UV" printer for Scotch Print Graphics, from 3M Company, may be used upon modification according to the principles described above. The invention may also be used in a variety of known drum inkjet printers.

A number of other alternatives are also possible. Accordingly, the present invention should not be deemed limited to the specific examples that are set out above for purposes of illustration, but instead only by a fair scope of the claims which follow along with their equivalents.

What is claimed is:

1. Inkjet printing apparatus for radiation curable ink comprising:

a support for receiving a substrate;

a print head for directing radiation curable ink toward a substrate received on the support;

a source of radiation for providing radiation to ink received on the substrate;

a sensor for sensing the amount of radiation emitted by the source of radiation, wherein the sensor is laterally offset from the substrate when the substrate is received on the support;

a controller having an input for receiving a signal from the sensor and at least one characteristic of the ink, substrate or printing productivity parameters, wherein the controller is connected to the source of radiation and varies the amount of radiation delivered by the source of radiation in accordance with the signal received from the sensor and the at least one characteristic of the ink, substrate or printing productivity parameters; and a drive mechanism for moving the source of radiation across the substrate and toward the sensor.

2. Inkjet printing apparatus according to claim 1 wherein the apparatus is a flat bed printer, and wherein the drive mechanism moves the source of radiation to a location adjacent the sensor a plurality of times during the course of printing an image on the substrate.

3. Inkjet printing apparatus according to claim 2 wherein the drive mechanism moves the source of radiation across the substrate along a relatively straight reference axis, and wherein the reference axis extends to a location adjacent the sensor.

4. Inkjet printing apparatus according to claim 1 wherein the source of radiation is an ultraviolet source of radiation.

5. Inkjet printing apparatus according to claim 1 wherein the input of the controller receives at least one characteristic of the substrate and at least one characteristic of the ink.

6. Inkjet printing apparatus according to claim 1 wherein the drive mechanism is operable to move the source of radiation along a relatively straight reference axis, and wherein the reference axis extends to a location adjacent the sensor.

7. Inkjet printing apparatus according to claim 1 wherein the apparatus includes a first drive mechanism for moving the source of radiation across the substrate in a first direction, and a second drive mechanism for moving the source of radiation across the substrate in a second direction, and wherein the first direction is generally perpendicular to the second direction.

8. Inkjet printing apparatus according to claims 7 wherein the support extends generally in a reference plane, and wherein the first direction and the second direction are generally parallel to the reference plane.

9. A method of inkjet printing comprising:

selecting a radiation curable ink;

selecting a substrate;

entering at least one characteristic of the ink, substrate or printing productivity parameters into a controller;

directing the ink onto the substrate;

activating a source of radiation for providing radiation to ink received on the substrate;

sensing the amount of radiation emitted by the source of radiation; and varying the amount of radiation delivered by the source of radiation in accordance with the sensed amount of radiation and the at least one characteristic of the ink, substrate or printing productivity parameters, wherein the act of varying the amount of radiation is carried out by moving one or more filters or lens elements along a path of travel that intersects the path of travel of radiation directed toward ink received on the substrate.

10. A method of inkjet printing comprising:

selecting a radiation curable ink;

selecting a substrate;

entering at least one characteristic of the ink, substrate or printing productivity parameters into a controller;

directing the ink onto the substrate;

activating a source of radiation for providing radiation to ink received on the substrate;

sensing the amount of radiation emitted by the source of radiation; and varying the amount of radiation delivered by the source of radiation in accordance with the sensed amount of radiation and the at least one characteristic of the ink, substrate or printing productivity parameters, wherein the act of activating a source of radiation includes the act of activating a number of light sources, and wherein the act of varying the amount of radiation is carried out by varying the number of activated light sources.

11. The method of inkjet printing according to claim 10 wherein the act of activating a source of radiation is carried out by activating a source of UV radiation.

12. A method of inkjet printing comprising:

selecting a radiation curable ink;

selecting a substrate;

entering at least one characteristic of the ink, substrate or printing productivity parameters into a controller;

directing the ink onto the substrate;

activating a source of radiation for providing radiation to ink received on the substrate;

sensing the amount of radiation emitted by the source of radiation; and varying the amount of radiation delivered by the source of radiation in accordance with the sensed amount of radiation and the at least one characteristic of the ink, substrate or printing productivity parameters, wherein the act of varying the amount of radiation is carried out by changing the distance between the source of radiation and the substrate.

13. Inkjet printing apparatus for radiation curable ink comprising:

a support for receiving a substrate;

a print head for directing radiation curable ink toward a substrate received on the support;

a source of radiation;

a sensor for sensing the amount of radiation emitted by the source of radiation; and means for directing the radiation along a first path toward the substrate in order to provide radiation to ink received on the substrate and for also directing the radiation along a second path toward the sensor, wherein the first path is different from the second path.

14. Inkjet printing apparatus according to claim 13 wherein the first path is generally parallel to the second path.

15. Inkjet printing apparatus according to claim 13 wherein the second path is laterally offset from the support.

16. Inkjet printing apparatus according to claim 13 wherein the means for directing radiation comprises a drive mechanism for moving the source of radiation.

17. Inkjet printing apparatus according to claim 13 wherein the source of radiation is an ultraviolet source of radiation.

18. Inkjet printing apparatus according to claim 13 wherein the apparatus is a roll-to-roll printer.

19. Inkjet printing apparatus according to claim 13 wherein the apparatus is a flatbed printer.

20. A method of inkjet printing comprising:

providing a substrate;

applying radiation curable ink to the substrate;

directing radiation along a first path and toward ink received on the substrate;

directing radiation along a second path and toward a radiation sensor; and varying the amount of radiation directed toward the ink in accordance with the amount of radiation detected by the sensor, wherein the act of varying the amount of radiation is carried out by moving one or more filters along a path of travel that intersects the path of travel of the first path.

21. A method of inkjet printing comprising:

providing a substrate;

applying radiation curable ink to the substrate;

directing radiation along a first path and toward ink received on the substrate;

directing radiation along a second path and toward a radiation sensor; and varying the amount of radiation directed toward the ink in accordance with the amount of radiation detected by the sensor.

wherein the act of directing radiation along a first path includes the act of activating a number of lamps, and wherein the act of varying the amount of radiation is carried out by varying the number of activated lamps.

22. A method of inkjet printing comprising:

providing a substrate;

applying radiation curable ink to the substrate;

directing radiation along a first path and toward ink received on the substrate;

directing radiation along a second path and toward a radiation sensor; and varying the amount of radiation directed toward the ink in accordance with the amount of radiation detected by the sensor;

wherein the act of varying the amount of radiation is carried out by changing the distance between the source of radiation and the substrate.

23. The method of inkjet printing according to claim 22 wherein the act of activating a source of radiation is carried out by activating a source of UV radiation.

24. Inkjet printing apparatus for radiation curable ink comprising:

a support for receiving a substrate;

a print head for directing radiation curable ink toward a substrate received on the support;

a source of radiation;

a drive mechanism for moving the source of radiation along a path across the substrate in order to provide radiation to ink received on the substrate, wherein the path also extends to a certain location laterally offset from the substrate; and a sensor next to the certain location for sensing the amount of radiation emitted by the source of radiation when the source of radiation is in the certain location.

25. Inkjet printing apparatus according to claim 24 wherein the apparatus is a flat-bed printer, and wherein the drive mechanism moves the source of radiation to the certain location a plurality of times during the course of printing an image on the substrate.

26. Inkjet printing apparatus according to claim 24 wherein the drive mechanism comprises a first drive mechanism for moving the source of radiation across the substrate in a first direction and a second drive mechanism for moving the source of radiation across the substrate in a second direction, and wherein the first direction is generally perpendicular to the second direction.

27. Inkjet printing apparatus according to claim 26 wherein the support extends generally in a reference plane, and wherein the first direction and the second direction are generally parallel to the reference plane.

28. Inkjet printing apparatus according to claim 24 wherein the source of radiation is an ultraviolet source of radiation.

29. A method of inkjet printing comprising:

providing a substrate;

applying radiation curable ink to the substrate;

moving a source of radiation across the substrate in order to provide radiation to ink received on the substrate;

moving the source of radiation to a certain location that is laterally offset from the substrate; and sensing the amount of radiation emitted by the source of radiation when the source of radiation is in the certain location.

30. A method of inkjet printing according to claim 29 wherein the method also includes the act of varying the amount of radiation emitted by the source of radiation in accordance with the sensed amount of radiation.

31. The method of inkjet printing according to claim 30 wherein the act of varying the amount of radiation is carried out by varying the intensity of radiation.

32. The method of inkjet printing according to claim 30 wherein the act of varying the amount of radiation is carried out by changing the voltage of power supplied to the source of radiation.

33. The method of inkjet printing according to claim 30 wherein the act of varying the amount of radiation is carried out by moving one or more filters along a path of travel that intersects the path of travel of radiation directed toward ink received on the substrate.

34. The method of inkjet printing according to claim 30 wherein the act of varying the amount of radiation is carried out by varying the relative rate of passage of the source of radiation across ink received on the substrate.

35. The method of inkjet printing according to claim 30 wherein the act of varying the amount of radiation is carried out by varying a number of activated lamps.

36. The method of inkjet printing according to claim 30 wherein the act of varying the amount of radiation is carried out by varying a rate of pulsation of radiation lamps.

37. The method of inkjet printing according to claim 30 wherein the act of varying the amount of radiation is carried out by changing the distance between the source of radiation and the substrate.

* * * * *

UNITED STATES PATENT AND TRADEMARK OFFICE

CERTIFICATE OF CORRECTION

PATENT NO. : 7,140,711 B2
APPLICATION NO. : 10/624012
DATED : November 28, 2006
INVENTOR(S) : Bruce A. Nerad It is certified that error appears in the above-identified patent and that said Letters Patent is hereby corrected as shown below:

Column 2
Line 23, Delete "ink–jet" and insert -- inkjet --, therefor.

Column 3
Line 1, Delete "ink–jet" and insert -- inkjet --, therefor.
Line 55, Delete "ink–jet" and insert -- inkjet --, therefor.

Column 4
Line 33, Delete "ink–jet" and insert -- inkjet --, therefor.

Column 10
Line 55, In Claim 8, delete "claims" and insert -- claim --, therefor.

Column 12
Line 40, In Claim 21, delete "sensor." and insert -- sensor, --, therefor.
Line 55, In Claim 22, delete "sensor;" and insert -- sensor, --, therefor.

Signed and Sealed this

Thirteenth Day of February, 2007

JON W. DUDAS
*Director of the United States Patent and Trademark Office*